US010493370B2

(12) United States Patent
Malone

(10) Patent No.: US 10,493,370 B2
(45) Date of Patent: Dec. 3, 2019

(54) SYSTEM AND METHOD FOR FILLING CONTAINERS WITH FLUIDS AND SEALING THE FILLED CONTAINERS

(71) Applicant: Tinnus Enterprises, LLC, Plano, TX (US)

(72) Inventor: Joshua Malone, Plano, TX (US)

(73) Assignee: Tinnus Enterprises, LLC, Plano, TX (US)

( * ) Notice: Subject to any disclaimer, the term of this patent is extended or adjusted under 35 U.S.C. 154(b) by 193 days.

(21) Appl. No.: 15/188,702

(22) Filed: Jun. 21, 2016

(65) Prior Publication Data

US 2017/0361239 A1 Dec. 21, 2017

(51) Int. Cl.
*A63H 27/10* (2006.01)
*B65B 3/04* (2006.01)

(52) U.S. Cl.
CPC ..... *A63H 27/10* (2013.01); *B65B 3/04* (2013.01); *A63H 2027/1033* (2013.01); *A63H 2027/1041* (2013.01)

(58) Field of Classification Search
CPC ..... A63H 27/10; A63H 2027/1033; A63H 2027/1041; B65B 3/04; A61K 49/0076;
(Continued)

(56) References Cited

U.S. PATENT DOCUMENTS 262,517 A 8/1882 Unz et al.
1,098,286 A 5/1914 Miller
(Continued)

FOREIGN PATENT DOCUMENTS

AU 2015201240 3/2015
AU 2015101248 10/2015
(Continued)

OTHER PUBLICATIONS

National Research Council; "Solid Particles in Suspension—Drinking Water and Health"; National Academies Press; 1977.*
(Continued)

*Primary Examiner* — Andrew D St Clair
(74) *Attorney, Agent, or Firm* — Brett A. Mangrum

(57) ABSTRACT

In one embodiment, an apparatus for simultaneously filling balloons with water generally includes a fitting and at least three branch assemblies coupled to the fitting. The fitting includes an inlet and at least three outlets. Each branch assembly includes a tube, a balloon, an elastic ring, and a plurality of colloid particles disposed within the balloon. For each branch assembly, the tube extends from its respective fitting at a respective one of the at least three outlets; the balloon has a neck defining an opening through which an end of the tube is inserted; and the elastic ring. Each elastic ring compresses the neck of the balloon around the end of the tube. The elastic ring is configured to restrict detachment of the balloon from the tube and to automatically seal the opening of the balloon upon detachment of the balloon from the tube. The restriction of the elastic ring is limited such that the balloon, if filled with a sufficient amount of water, is detachable by gravity or by gravity combined with a manually applied acceleration of the tube. The plurality of colloid particles, if suspended within water, are capable of plugging a hole 500 microns wide or less that would otherwise permit water to leak from the balloon.

19 Claims, 4 Drawing Sheets

(58) Field of Classification Search
CPC ..... A61K 49/0078; A61K 49/008; A61K 49/0089; B29C 73/16; B29C 73/22; B29C 73/166
See application file for complete search history.

(56) References Cited

U.S. PATENT DOCUMENTS

| | | | | |
|---|---|---|---|---|
| 1,166,690 | A | 1/1916 | Kahn | |
| 1,236,865 | A | 8/1917 | Pittenger | |
| 1,350,935 | A | 8/1920 | Pastor | |
| 1,478,757 | A | 12/1923 | O'connor | |
| 1,484,575 | A | 2/1924 | Shulin | |
| 1,703,463 | A | 2/1929 | Weigel | |
| 2,027,225 | A | 1/1936 | Gill | |
| 2,161,274 | A | 6/1939 | Behrend | |
| 2,553,941 | A | 5/1951 | Raab | |
| 2,617,624 | A | 11/1952 | Annis | |
| 2,656,669 | A | 10/1953 | Avansino | |
| 2,757,960 | A | 7/1956 | Hatcher | |
| 2,922,252 | A | 1/1960 | Van Dam et al. | |
| 2,924,041 | A | 9/1960 | Jackson | |
| 3,105,613 | A | 10/1963 | Barton et al. | |
| 3,108,396 | A | 10/1963 | Dorman | |
| 3,118,672 | A | 1/1964 | Dorn | |
| 3,154,050 | A | 10/1964 | Hanson | |
| 3,161,998 | A | 12/1964 | Muehlenbeck | |
| 3,301,490 | A | 1/1967 | Hruby, Jr. | |
| 3,368,302 | A | 2/1968 | Martino | |
| 3,536,576 | A * | 10/1970 | Schwartz | A41D 31/0016 2/2.11 |
| 3,580,303 | A | 5/1971 | Roberge | |
| 3,820,200 | A | 6/1974 | Myers | |
| 3,978,555 | A | 9/1976 | Weisenthal | |
| 4,212,460 | A | 7/1980 | Kraft | |
| 4,416,038 | A | 11/1983 | Morrone, III | |
| 4,428,149 | A | 1/1984 | Brown | |
| 4,684,137 | A | 8/1987 | Armer, Jr. | |
| 4,687,458 | A | 8/1987 | Handa | |
| 4,741,448 | A | 5/1988 | Alley et al. | |
| 4,892,500 | A | 1/1990 | Lau | |
| 4,911,379 | A | 3/1990 | Kopelman | |
| 4,944,709 | A | 7/1990 | Lovik | |
| 5,004,633 | A | 4/1991 | Lovik | |
| 5,014,757 | A | 5/1991 | Donaldson et al. | |
| 5,029,851 | A | 7/1991 | Hagen | |
| 5,036,985 | A | 8/1991 | Lovik | |
| 5,119,281 | A | 6/1992 | Akman | |
| 5,127,867 | A | 7/1992 | Lau | |
| 5,135,222 | A | 8/1992 | Spector | |
| 5,158,803 | A * | 10/1992 | Haas | B29C 73/163 106/33 |
| D335,901 | S | 5/1993 | Gill, III | |
| 5,240,450 | A | 8/1993 | Graham | |
| 5,234,726 | A | 9/1993 | Dahan | |
| 5,293,707 | A | 3/1994 | Shaeffer | |
| 5,301,392 | A | 4/1994 | Richman | |
| 5,370,161 | A | 12/1994 | Shafer | |
| 5,381,964 | A | 1/1995 | Reyna | |
| 5,439,199 | A | 8/1995 | Briggs et al. | |
| 5,444,962 | A | 8/1995 | Bonnet | |
| 5,496,203 | A | 3/1996 | Murray | |
| 5,509,540 | A | 4/1996 | Pomerantz | |
| 5,531,626 | A | 7/1996 | Deal | |
| 5,538,456 | A | 7/1996 | Liu et al. | |
| 5,588,896 | A | 12/1996 | Goodman | |
| 5,628,091 | A | 5/1997 | Mueller | |
| 5,639,526 | A | 6/1997 | Kotsiopoulos et al. | |
| 5,732,530 | A | 3/1998 | Pfaff | |
| 5,755,419 | A | 5/1998 | Gearhart | |
| 5,826,803 | A | 10/1998 | Cooper | |
| 5,944,576 | A | 8/1999 | Nelson et al. | |
| 5,964,636 | A | 10/1999 | Carrera | |
| 5,975,983 | A | 11/1999 | Panec | |
| 6,007,403 | A | 12/1999 | Urspringer et al. | |
| 6,024,251 | A | 2/2000 | Mayer | |
| 6,047,866 | A | 4/2000 | Brown | |
| 6,106,135 | A | 8/2000 | Zingale | |
| 6,149,488 | A | 11/2000 | Stark | |
| 6,158,619 | A | 12/2000 | D'andrade | |
| 6,176,758 | B1 | 1/2001 | Wu | |
| 6,179,823 | B1 | 1/2001 | Niedospial, Jr. | |
| 6,386,938 | B1 | 5/2002 | Novak | |
| 6,419,825 | B1 | 7/2002 | Hahmann et al. | |
| 6,478,057 | B1 | 11/2002 | Bearss | |
| 6,478,651 | B1 | 11/2002 | Weir | |
| 6,488,557 | B1 | 12/2002 | Elliott et al. | |
| 6,527,615 | B1 | 3/2003 | Boehler | |
| 6,558,223 | B1 | 5/2003 | Matthews | |
| 6,598,807 | B1 | 7/2003 | Anzalone | |
| 6,716,083 | B1 | 4/2004 | Castro | |
| 6,793,094 | B2 | 9/2004 | Turnbough | |
| 7,388,041 | B2 | 6/2008 | Cegelski et al. | |
| 7,444,938 | B2 | 11/2008 | Tippmann | |
| 7,445,533 | B2 | 11/2008 | Norton et al. | |
| 7,479,130 | B2 | 1/2009 | Trickett | |
| 7,762,214 | B2 | 7/2010 | Ritchey | |
| 8,037,906 | B1 | 10/2011 | Grillo | |
| 8,141,326 | B2 | 3/2012 | Wang | |
| 8,251,111 | B2 | 8/2012 | Nelson et al. | |
| 8,479,776 | B2 | 7/2013 | Berardi | |
| 8,733,675 | B2 | 5/2014 | Leber | |
| 8,789,565 | B1 | 7/2014 | Wicken | |
| 9,051,066 | B1 * | 6/2015 | Malone | A61J 1/10 |
| 9,242,749 | B2 | 1/2016 | Malone | |
| 9,315,282 | B2 | 4/2016 | Malone | |
| 2001/0003505 | A1 | 6/2001 | Bertrand | |
| 2004/0127311 | A1 | 7/2004 | Brock | |
| 2004/0174718 | A1 | 9/2004 | Ohlund | |
| 2005/0004430 | A1 | 1/2005 | Lee | |
| 2005/0138862 | A1 | 6/2005 | O'connor | |
| 2005/0176339 | A1 | 8/2005 | Cuisinier | |
| 2006/0291217 | A1 | 12/2006 | Vanderschuit | |
| 2007/0167107 | A1 | 7/2007 | Petell et al. | |
| 2008/0121309 | A1 | 5/2008 | Boise | |
| 2008/0166943 | A1 | 7/2008 | Hou | |
| 2010/0049316 | A1 * | 2/2010 | Schuessler | A61F 2/12 623/8 |
| 2010/0326212 | A1 | 12/2010 | Furey et al. | |
| 2011/0079316 | A1 | 4/2011 | Ramere | |
| 2011/0151744 | A1 | 6/2011 | Archer | |
| 2011/0253256 | A1 | 10/2011 | Finley | |
| 2013/0118640 | A1 | 5/2013 | Saggio | |
| 2013/0226219 | A1 | 8/2013 | Brister et al. | |
| 2014/0030452 | A1 | 1/2014 | Warner | |
| 2014/0076454 | A1 | 3/2014 | Kjar | |
| 2014/0212074 | A1 | 7/2014 | Durst | |
| 2014/0316207 | A1 | 10/2014 | Hain | |
| 2015/0020480 | A1 | 1/2015 | Harris | |
| 2015/0056887 | A1 | 2/2015 | Harter et al. | |
| 2016/0052656 | A1 | 2/2016 | Malone | |
| 2016/0083121 | A1 | 3/2016 | Malone | |
| 2016/0083122 | A1 | 3/2016 | Malone | |
| 2016/0101882 | A1 | 4/2016 | Malone | |

FOREIGN PATENT DOCUMENTS

| | | |
|---|---|---|
| CN | 201161115 | 10/2008 |
| DE | 102015206176 | 4/2015 |
| EP | 1548420 | 6/2005 |
| FR | 2911512 | 7/2008 |
| FR | 3017381 | 8/2015 |
| GB | 294273 | 7/1928 |
| GB | 1277377 | 6/1972 |
| WO | WO199408849 | 4/1994 |
| WO | WO2015027187 | 2/2015 |
| WO | WO2015118518 | 8/2015 |
| WO | WO2015119516 | 8/2015 |

OTHER PUBLICATIONS

Koohestanian et al.; "The Separation Method for Removing of Colloidal Particles from Raw Water"; IDOSI Publications; 2008.*

(56) References Cited

OTHER PUBLICATIONS

Petition for Post-Grant Review of U.S. Pat. No. 9,051,066, filed in the United States Patent and Trademark Office dated Jun. 22, 2015, Case No. PGR2015-00018.
Search and Examination Report from the United Kingdom Patent Office, United Kingdom patent application 1504038.9.
Examination Report from the Australian Patent Office, Patent App. No. 2015101248.
International Search Report issued by the Australian Patent Office, PCT/IB2015/051747.
International Search Report issued by the New Zealand Patent Office, PCT/NZ2015/050025.
Opinion of International Preliminary Examining Authority, Australian Patent Office, PCT/IB2015/051747.
European Search Report, EP15158482.
Extended European Search Report, Belgian Patent Office, App. No. 201505223.
Novelty Search Report, Hungarian Patent Office, App. No. P1500153.
Bunch O Balloons Kickstarter page, available at https://www.kickstarter.com/projects/bunchoballoons/bunch-oballoons-100-water-balloons-in-less-than-1, printed Aug. 9, 2015.
"Bunch O Balloons . . . make 100 water balloons in less than a minute!", available at https://www.youtube.com/watch?v=S1DaXYT6O2A, according to the International Search Report for PCT/IB2015/051747: "Viewed on internet on Aug. 20, 2015 . . . Published on Aug. 5, 2014".
Amazon Customer Review, "These balloons are filled with colored water for even more fun!", dated Jun. 9, 2016, available at https://www.amazon.com/gp/customer-reviews/R1OODMIEHRQXR0/ref=cm_cr_getr_d_rvw_ttl?ie=UTF8&ASIN=B01C0OIRTE.
https://web.archive.org/web/20160606220014/http://www.zimplikids.com/new-2016-slime-bombz.html.

* cited by examiner

SYSTEM AND METHOD FOR FILLING CONTAINERS WITH FLUIDS AND SEALING THE FILLED CONTAINERS

TECHNICAL FIELD

The present disclosure relates generally to fluid inflatable systems and more particularly, to a system and method for filling containers with fluids and sealing the filled containers.

BACKGROUND

Inflatable containers such as balloons can be filled with a variety of fluids, such as air, helium, water, medicines, etc. In some cases, a lot of inflatable containers may need to be filled with fluids. For example, balloons used as props in conventions, large parties, etc. may number in the hundreds and may require substantial human effort to fill them all in a timely manner. In another example, water balloons used as kids' toys may need to be filled in large numbers to aid in various games. Various methods may be employed to fill such inflatable containers. For example, an individual may blow up and tie each balloon by hand or use a tank of compressed air or helium to inflate the balloon, which then has to be tied. In another example, an individual may fill water balloons with water by hand one at a time, and then tie the balloons, which can all be quite time-consuming. Moreover, the inflatable containers may be damaged or filled to different volumes. Various containers are particularly suitable for containing liquids, yet may be subject to undesirable leaks that may allow liquid to escape the container.

SUMMARY OF EXAMPLE EMBODIMENTS

In a first embodiment, an apparatus for simultaneously filling balloons with water generally includes a fitting and at least three branch assemblies coupled to the fitting. The fitting includes an inlet and at least three outlets. Each branch assembly includes a tube, a balloon, an elastic ring, and a plurality of colloid particles disposed within the balloon. For each branch assembly, the tube extends from its respective fitting at a respective one of the at least three outlets; the balloon has a neck defining an opening through which an end of the tube is inserted; and the elastic ring. Each elastic ring compresses the neck of the balloon around the end of the tube. The elastic ring is configured to restrict detachment of the balloon from the tube and to automatically seal the opening of the balloon upon detachment of the balloon from the tube. The restriction of the elastic ring is limited such that the balloon, if filled with a sufficient amount of water, is detachable by gravity or by gravity combined with a manually applied acceleration of the tube. The plurality of colloid particles, if suspended within water, are capable of plugging a hole 500 microns wide or less that would otherwise permit water to leak from the balloon.

In a second embodiment, an apparatus for simultaneously filling balloons with water generally includes a fitting and at least three branch assemblies coupled to the fitting. The fitting includes an inlet and at least three outlets. Each branch assembly includes a tube, a balloon, and an elastic ring. For each branch assembly, the tube extends from its respective fitting at a respective one of the at least three outlets; the balloon has a neck defining an opening through which an end of the tube is inserted; and the elastic ring. Each elastic ring compresses the neck of the balloon around the end of the tube. The elastic ring is configured to restrict detachment of the balloon from the tube and to automatically seal the opening of the balloon upon detachment of the balloon from the tube. The restriction of the elastic ring is limited such that the balloon, if filled with a sufficient amount of water, is detachable by gravity or by gravity combined with a manually applied acceleration of the tube. A colloid source is disposed within the fitting and configured to respond to pressurized water by supplying suspended colloid particles into the stream of pressurized water, such that each balloon receives a respect allotment of suspended colloid particles.

In particular examples of the first or second embodiments, the hole may comprise, for example, a pinhole defect in the sidewall of the balloon or a gap formed by compressed folds in the neck of the balloon. In certain instances, the cumulative mass of the colloid particles disposed within the balloon is within the range, for example, of 0.05 to 0.5 grams per liter of water or within the range of 0.2 to 2 grams per liter of water, for a maximum number of liters of water that the balloon may contain without bursting. The colloid particles disposed within the balloon, if suspended in water, may result in a colloidal solution having a dynamic viscosity of 33 or less at 27° C. in centipoise. The colloid particles may have respective maximum dimensions within the range, for example, of 1 nanometer to 0.1 centimeters or within the range of 200 to 500 microns. Certain colloid particles may comprise gelatin or may be biodegradable.

In a third embodiment, an apparatus for simultaneously filling containers with fluid generally includes a fitting and at least three branch assemblies coupled to the fitting. The fitting includes an inlet and at least three outlets. Each branch assembly includes a tube, a container, an elastic ring, and a plurality of colloid particles disposed within one or more selected from the housing, the tube and the container. For each branch assembly, the tube extends from its respective fitting at a respective one of the at least three outlets; the container has a flexible neck defining an opening through which an end of the tube is inserted; and the elastic ring. Each elastic ring compresses the neck of the container around the end of the tube. The elastic ring is configured to resist detachment of the container from the tube and to automatically seal the opening of the container upon detachment of the container from the tube. The plurality of colloid particles are able to be suspended within the fluid contained by the filled container, and when so suspended are capable of plugging a hole 500 microns wide or less that would otherwise permit fluid to leak from the container.

In a fourth embodiment, an apparatus for simultaneously filling containers with fluid generally includes a fitting and at least three branch assemblies coupled to the fitting. The fitting includes an inlet and at least three outlets. Each branch assembly includes a tube, a container, and an elastic ring. For each branch assembly, the tube extends from its respective fitting at a respective one of the at least three outlets; the container has a flexible neck defining an opening through which an end of the tube is inserted; and the elastic ring. Each elastic ring compresses the neck of the container around the end of the tube. The elastic ring is configured to resist detachment of the container from the tube and to automatically seal the opening of the container upon detachment of the container from the tube. A colloid source is disposed within the fitting and configured to respond to pressurized water by supplying suspended colloid particles into the stream of pressurized water, such that each container receives a respect allotment of suspended colloid particles.

In particular examples of the third or fourth embodiments, the fluid is one or more selected from a liquid and a gas. In certain instances, the restriction of the elastic ring is limited such that the container, if filled with a sufficient amount of fluid, is detachable by gravity or by gravity combined with a manually applied acceleration of the tube. The hole may comprise, for example, a pinhole defect in the sidewall of the balloon or a gap formed by compressed folds in the neck of the balloon. The cumulative mass of the colloid particles disposed within the container may be within the range, for example, of 0.05 to 0.5 grams. In certain instances, the colloid particles have respective maximum dimensions within the range of 1 nanometer to 0.1 centimeters. The colloid particles may be biodegradable.

Additional detail of the above four example embodiments, and other alternative embodiments, is provided in the remainder of the present disclosure.

BRIEF DESCRIPTION OF THE DRAWINGS

To provide a more complete understanding of the present disclosure and features and advantages thereof, reference is made to the following description, taken in conjunction with the accompanying figures, wherein like reference numerals represent like parts, in which.

DESCRIPTION OF EXAMPLE EMBODIMENTS

Overview

Certain embodiments disclosed herein enable a single operator to fill, seal, and detach multiple containers at once, as taught by various embodiments of U.S. Pat. No. 9,051,066, the entire content of which is incorporated herein by reference.

In accordance with the present disclosure, certain disadvantages and problems associated with filling and sealing containers have been substantially reduced or eliminated. One example object of the present disclosure, for example, is to mitigate liquid leaks from containers, such as through fold gaps, pinholes in the sidewall, or any other defect that may cause leakage. A second example object of the present disclosure is to prevent leaking while preserving the desired characteristics of the liquid held within the container. For example, certain embodiments may minimize leaking while maintaining little to no change of the viscosity of the fluid within the containers.

Other technical advantages of the present disclosure will be readily apparent to one skilled in the art from the following figures, descriptions, and claims. Moreover, while specific advantages have been enumerated above, various embodiments may include all, some, or none of the enumerated advantages.

Description

The example embodiments of the present disclosure are best understood by referring to FIGS. 1 through 9 of the drawings, like numerals being used for like and corresponding parts of the various drawings.

Figure 1:
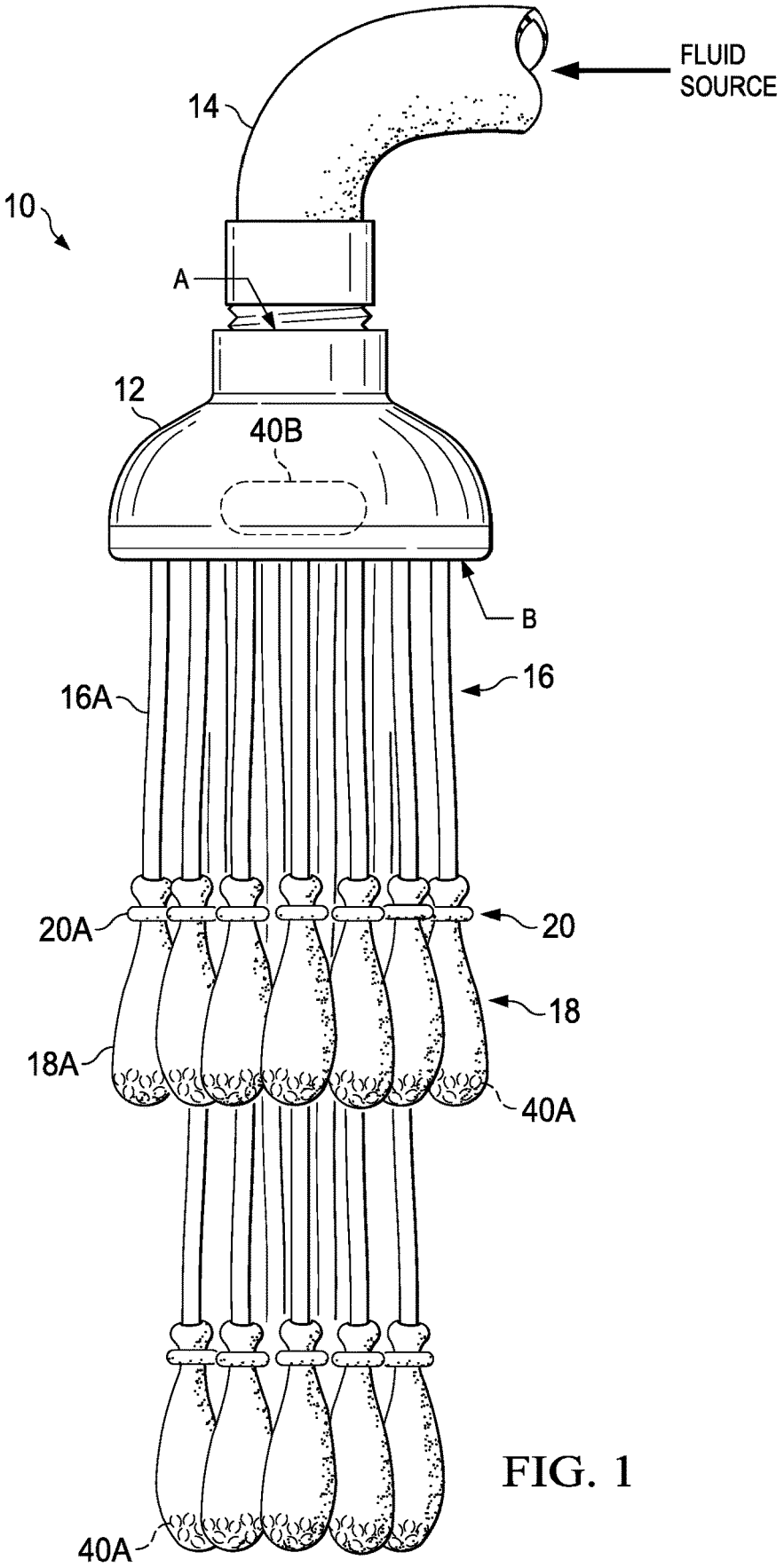
FIG. 1 is a simplified perspective view illustrating a system for filling containers with fluids, according to an example embodiment.

FIG. 1 is a simplified perspective view illustrating a system 10 for filling containers with fluids, according to an example embodiment. In the illustrated embodiment, system 10 generally includes a housing 12 removably attached to a fluid source 14 (e.g., hose, tube, pipe, etc.) on a first end A and to hollow tubes 16 on a second end B, and multiple containers 18 each coupled to each tube 16 by a respective valve 20. As used herein, the term "housing" at least encompasses a casing defining at least a partially enclosed space that permits ingress and egress of fluid. In certain embodiments, such a casing may be synonymous with other terms known in the art including, for example, fitting, covering, skin, sleeve, sheath, etc. As shown in FIG. 1, end A of housing 12 includes a rigid or semi-rigid threaded opening configured to mate with corresponding threads on fluid source 14; end B of housing 12 includes a plurality of holes, each coupled to a respective tube 16; and end A is smaller in circumference or area than end B; however, any suitable configuration may be used. The holes of housing 12 may have any suitable configuration. In certain embodiments, for example, the holes may be disposed along one or more planar or non-planar arrays.

Fluid source 14 generally encompasses any structure configured to supply fluid from a source. For example, fluid source 14 may be a hose connected to a water tank, gas tank, water supply line, or any other suitable source of fluid.

In the illustrated embodiment, each tube 16 has one end coupled to housing 14, another end coupled to a respective container 18, and is configured to conduct fluid from housing 14 into its respective container 18. As shown in FIG. 1, for example, one end of an example tube 16A may be fitted through a hole in end B of housing 12, and the other end of tube 16A may be inserted into an example container 18A. Tubes 16 may be coupled to housing 12 in any suitable manner. In some embodiments, for example, tubes 16 may be permanently attached to housing 12 (e.g., welded, brazed, stuck with adhesives, press-fitted, etc.). In certain other embodiments, tubes 16 may be removably attached to housing 12 (e.g., with threads, pressure, etc.). Likewise, each tube 16 may be coupled to its respective container 18 in any suitable manner. As shown in FIG. 1, for example, each container 18 may be clamped (e.g., attached, fastened, held, clinched, secured, etc.) to a respective tube 16 using a respective valve 20. In certain embodiments, each tube 16 may have a sufficiently narrow diameter to restrict fluid from flowing through the tube in the event the corresponding balloon is detached. This aspect may be achieved, for example, by a tube 16 that has an outer diameter of 10 millimeters or less, with a preferred embodiment having an outer diameter of 2.2 millimeters; however, any suitable dimensions may be used. To facilitate decoupling containers 18 from tubes 16, among other objectives, particular embodiments may use tubes 16 having an outer diameter that is less than the inner diameter of a neck of the containers 18 while in an unstretched or relaxed state.

In some embodiments, tubes 16 may be made of a rigid material (e.g., steel, glass); in other embodiments, tubes 16 may be made of a flexible material (e.g., thin plastic). In some embodiments, tubes 16 may be thick, short and rigid; in other embodiments, tubes 16 may be slender, long and flexible. Thus, hollow tubes 16 may be flexible, semi-rigid, or rigid, based on its material of construction, design, or a combination thereof. As shown in FIG. 1, tubes 16 may be of different lengths, which in certain configurations may prevent crowding and may accommodate a larger number of containers 18 than would be possible if tubes 16 were of the same length. Thus, at least some of hollow tubes 16 may be of different lengths than the others.

Each container 18 may at least include an opening and a cavity for containing fluid. In certain embodiments, the opening facilitates removably clamping the container 18 to its respective tube 16 and to permit filling the container 18 with fluid. As used herein, the term "container" at least encompasses an object that may be filled with and may contain a fluid. For example, containers 18 may comprise inflatable balloons that may be filled with gaseous fluids, such as air or helium. Additionally, or alternatively, containers 18 may be configured to be filled with liquid fluids, such as water, fuel, drink, or any other liquid to be contained. As another example, particular containers 18 may be configured, for example, to be filled with gaseous or liquid medications, or with body fluids, such as urine or blood, to accommodate collecting multiple samples simultaneously for testing. Virtually any type and kind of fluid may be used within the broad scope of the embodiments.

Certain containers 18 may be flexible to accommodate expansion of the diameter of the containers 18 while being filled with fluid. In a preferred embodiment the container is a latex balloon. Note that in some embodiments, containers 18 are not necessarily inflatable or flexible in their entireties. For example, a first portion of containers 18 may be inelastic (e.g., glass, plastic, metal, etc., of fixed shape and size), and a second portion may be flexible enough to be inserted around tubes 16 and clamped thereon. As a more specific example, in certain embodiments, containers 18 may each be a glass vial, a plastic bottle, or a vinyl pouch.

As used herein, the term "elastic" is meant to refer to a property of a material that allows the material to resume its normal shape spontaneously after contraction, dilation, or distortion. In an example, an elastic material may be stretched to 200% of its original length, and the material may return to its original length when the stretching force is removed.

The term "valve" at least encompasses any object that regulates, directs, or controls the flow of fluids, by opening, closing, or partially obstructing passageways of fluid flow. In certain embodiments, valves 20 comprise elastic fasteners. For example, valves 20 may comprise elastic rings, such as rubber-bands or O-rings having a mechanical gasket typically in a toroid shape. Valves 20 may be constructed of any suitable material. For example, valves 20 may be made of thin steel, a coiled spring, rubber, any combination thereof, or any other suitable material. In a preferred embodiment the elastic ring is made from latex rubber.

Certain valves 20 may be structurally and functionally defined as a pinch valve. In particular embodiments, valves 20 comprise corrugations, smocking, elastic fibers, etc. fabricated into the necks of containers 18, such that force is required to pull open the necks of containers 18, and removal of the force causes the necks to constrict and close. In various embodiments, valves 20 comprise internal or external plugs. For example, certain plugs may be disposed within the container itself, as explained further below. Certain other plugs may be affixed to the necks of containers 18 and may be configured to allow receive tubes 16 therein to clamp containers 18 to tubes 16.

In certain embodiments, valve 20A may be of sufficient size to expand and clamp around tube 16A may be dispose around (e.g., placed over) a neck (e.g., proximate to the opening) of container 18A, clamping and sealing container 18A to tube 16A. As shown in FIG. 1, for example, valve 20A may be considered to be in an open configuration when container 18A is attached to tube 16A. That is, while in an open configuration, the neck of container 18A is open, allowing container 18A to fill with fluid. After container 18A is filled with fluid, it may be removed from tube 16A, whereupon valve 20A may be configured to close, thereby closing the neck of container 18A and sealing the fluid inside.

One example objective of certain embodiments is to mitigate undesired leakage from containers 18, such as through fold gaps, small holes in the sidewall, or through any other defect that may cause leakage. Another example objective of certain embodiments is to prevent leaking while preserving desired characteristics of the liquid held within the container. One or more of these objectives (among others) may be achieved, at least in part, through the use of a colloid (e.g., colloids 40A and 40B).

The term "colloid" as used herein at least encompasses any substance(s) generally capable of mitigating undesired leakage of fluid from containers 18 by migrating toward and plugging such leaks. While suitable colloids 40 may have a variety of physical properties, in certain embodiments the colloids comprise particles having a maximum dimension within the general size range of 1 nanometer to 0.1 centimeters, 1 to 10,000 nanometers, 0.001 to 0.1 centimeters, or 0.025 to 0.075 centimeters; however, any suitable range may be used. In certain applications, such as certain water balloon embodiments, it may be desirable to have tighter control of the range of maximum dimensions of the colloid particles 40. For example, certain embodiments may preferentially use colloid particles having a maximum dimension (e.g., width or diameter) within the range of 200 to 500 microns. Suitable colloids may be further characterized by certain coagulating characteristics, such as, for example, accumulation, collection, adhesion between particles, adhesion to surfaces, dispersion or suspension in liquid, or any suitable combination thereof. In various applications, desirable properties of colloids may further include, for example, non-toxicity, edibility, biodegradability, and minimal cost. Suitable colloids have been found to include, for example, gelatin, pectin, xanthum gum, carrageenan, carboxymethylcellulose, agar, and guar gum; however, any suitable substance(s) may be used.

Introduction of a colloid to system 10 may be effected in any of a variety of ways. For example, a colloid may be introduced in powder form, pill form, concentrated liquid form, or any other suitable form. As shown in FIG. 1, for example, colloid particles 40A may be added to the containers 18 prior to filling the containers 18 with liquid. Additionally, or alternatively, a colloid 40B may be disposed within the intended fluid pathway, such as within housing 12, tube 16, or fluid source 14, and may be configured to be dispersed into the fluid as it passes through or around the colloid 40. FIG. 1 illustrates this symbolically by the representation of a colloid pill 40B disposed within housing 12; while FIG. 2 symbolically illustrates the reduction in size of the colloid pill 40B as particles thereof dislodge and are dispersed within pressured fluid passing around or through colloid pill 40B. As yet another example, a colloid 40 may be dispersed directly into the fluid supply (e.g., at some point upstream from housing 12). Certain embodiments may use all, some, or none of the above examples. As demonstrated by these non-limiting examples, a colloid 40 may be added using any suitable means and sequence, or combinations thereof.

In a particular embodiment, housing 12 has an internal cavity that is at least 26 mm wide, which is sufficiently large, for example, to allow a colloid pill 40B weighing up to at least 2 grams.

In a particular embodiment, addition of 0.2 to 2 grams of gelatin per liter of water is effective at plugging neck fold gaps, pinholes, and other defects typically found in mass-produced recreational water balloons 18, without any other significant effect to the water. For water balloons 18 having a capacity of 250 milliliters of water, for example, such a concentration translates to approximately 0.05 to 0.5 grams of gelatin per balloon 18. Using gelatin particles 40 having maximum dimensions within the range of 200 to 500 microns, such a concentration has been demonstrated to effectively seal water balloon defects up to 500 microns wide, thus effectively addressing the vast majority of defects typically found in mass-produced recreational water balloons 18. Gelatin is an example colloid that is biodegradable and non-toxic, which may be desirable characteristics for certain applications, such as recreational water balloons. Furthermore, such concentration has been demonstrated to show a negligible change to viscosity of the water, such that the sealing effect is achieved by coagulation of the gelatin at the hole, rather than by general thickening of the liquid.

In various embodiments, it may be advantageous to use sufficient colloid 40 to effectively plug of any leaks without causing any appreciable thickening of the liquid 35. For a given hole, a higher viscosity liquid will pass slower than a relatively lower viscosity liquid. For example, certain sizes of holes will rapidly pass water but indefinitely hold a more viscous liquid such as honey. Dynamic viscosities of some example liquids at 27° C. in centipoise include:

TABLE 1

| | |
|---|---|
| acetone | .316 |
| ethanol | 1.095 |
| castor Oil | 650 |
| ethylene glycol | 16.2 |
| glycerin | 950 |
| linseed oil | 33.1 |
| propylene glycol | 42 |
| water | .89 |

As can be seen from TABLE 1, glycerin at 950 centipoise is at last 1000 times higher viscosity than water at 0.89 centipoise. A material as viscous as glycerin may not be capable of passing through certain defects in a water balloon, such as particularly sized fold gaps or pinholes. Linseed oil at 33.1 centipoise is 37 times more viscous than water. However, experimentation has shown that linseed oil may still pass through certain neck fold gaps and pinholes found in certain water balloons. Accordingly, in preferred embodiments, a colloid 40 in any suitable concentration and having a viscosity less than or equal to 37 times than that of water may be ideal for addressing leakage in certain water balloon applications. Stated another way, certain preferred embodiments may use a colloid 40 having a dynamic viscosity of 33 or less at 27° C. in centipoise. More generally, if it is desirable to limit the thickness of the liquid, any colloid may be used that has sufficient concentration, such that the dominant sealing mechanism is coagulation rather than thickening of the liquid.

Figure 2:
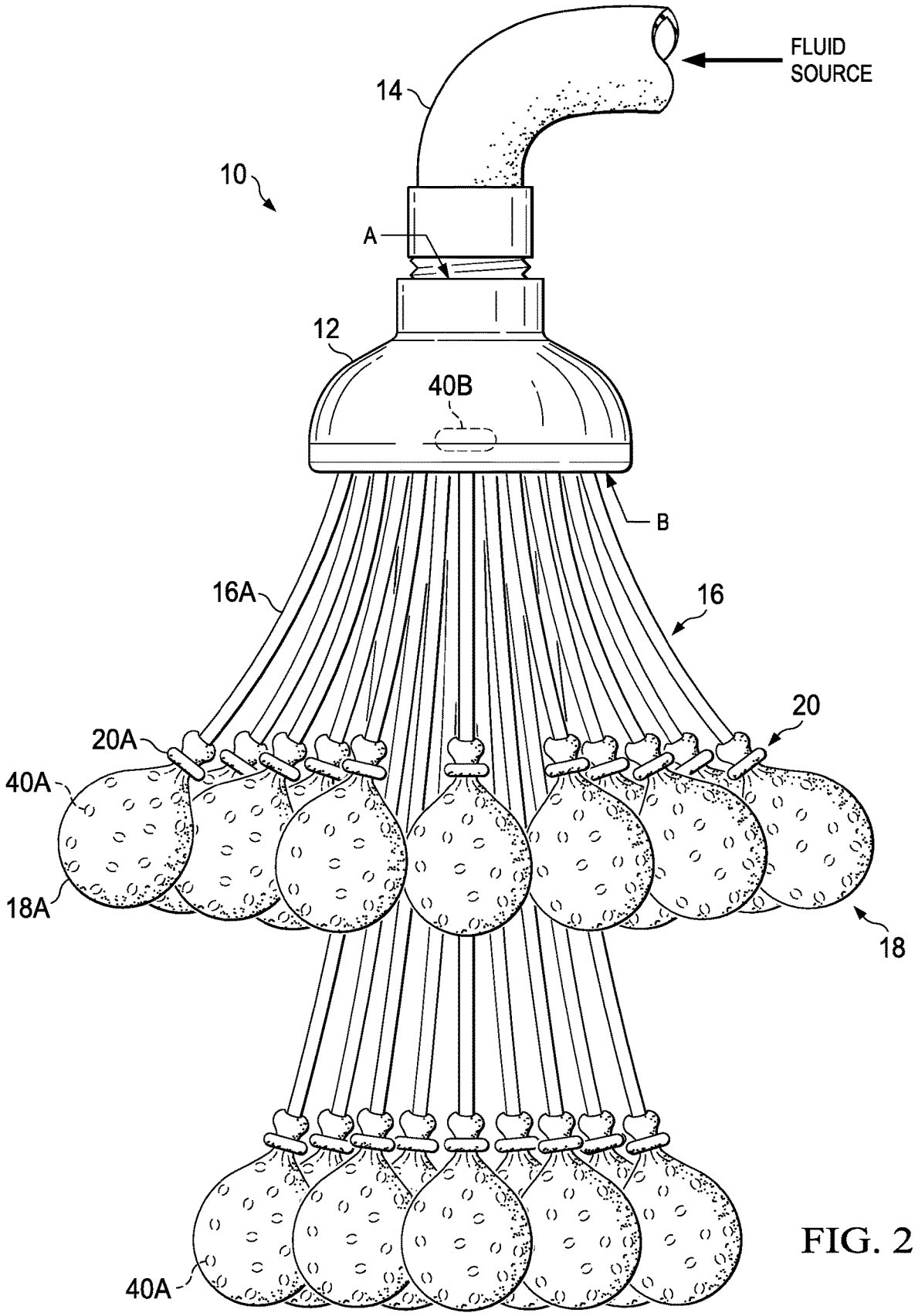
FIG. 2 is a simplified perspective view illustrating the system of FIG. 1 with the containers in a filled state, according to an example embodiment.

FIG. 2 is a simplified perspective view illustrating the system 10 of FIG. 1 with the containers 18 in a filled state, according to an example embodiment. To fill and seal containers 18, housing 12 may be attached to a fluid source 14 (e.g., via a garden hose) and the fluid supply may be turned on. When fluid source is turned on, system 10 may conduct the fluid through housing 12 and tubes 16 to each container 18. Containers 18 may be filled and may expand substantially simultaneously. In a particular embodiment, housing 12 is connected to a stream of liquid supplied at high pressure; however, any mechanism that facilitates fluid flow through tubes 16 at sufficient pressure to fill containers 18 may be used within the broad scope of the embodiments. In some embodiments, containers 18 may be marked with volumetric measurements, and fluid flow may be turned off when the fluid has filled containers 18 to a desired volume.

When containers 18 have reached a desired size or they are filled with a particular volume of fluid, they may be automatically or manually removed from tubes 16. System 10 may be configured to enable multiple containers 18 to detach at a time. For example, certain containers 18 may detach under their own weight by falling off, certain containers 18 may be manually shaken off, certain containers 18 may be pulled off, or any combination thereof may occur while in operation. That is, in certain instances, some or all of the filled containers 18 may be detached simultaneously by providing an acceleration on tubes 16, such as by manually shaking or lifting housing 12 with sufficient vigor to cause containers 18 to fall off from tubes 16. Additionally, in certain instances, containers 18 may fall off under gravity. For example, when filled containers 18 reach a threshold weight, they may slip off tubes 16 due to gravity (perhaps even without a manual acceleration manually applied to the tubes). The threshold weight may be at least partially based upon the tightness of valves 20, friction between tubes 16 and containers 18, and force from the weight of containers 18 and any fluid contained therein (among possibly other parameters). In some embodiments, the connecting force holding a filled container 18 to its corresponding tube 16 is not less than the weight of the filled container; in a specific embodiment, the connecting force holding each container 18 to its corresponding tube is exactly equal to the weight of the filled container 18. The connecting force may be provided by a combination of constricting forces and friction forces from valves 20. As each container 18 is removed from its corresponding tube 16, respective valves 20 may constrict the opening, thereby automatically sealing the container with the fluid inside In various embodiments, tubes 16 may be flexible to enable containers 18 to expand. As containers 18 fill with fluid and expand, they may push against each other, thereby causing certain at least tubes to flex 16 outward. As shown in FIG. 2, for example, as containers 18 reach a filled state, the outermost tubes 16 may be flexed more than the innermost tubes 16 (outer and inner being in reference to a center-point of housing 12, with the inner tubes 16 being closer to the center-point, and the outer tubes 16 being farther from the center-point).

As shown in FIG. 2, each filled container 18 has colloid particles 40 dispersed therein. In certain embodiments, the colloid particles 40 are suspended within the liquid. As explained further below, the suspended colloid particles 40 may be particularly suited to plug any defects in container 40 that might otherwise cause undesired leakage of the fluid.

Figure 3:
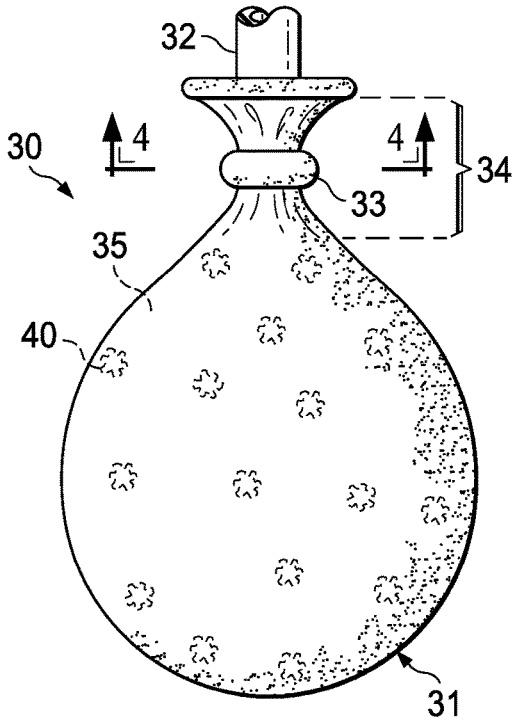
FIG. 3 illustrates a portion of a system for filling one or more containers with a liquid and mitigating leakage, according to an example embodiment.

FIG. 3 illustrates an apparatus 30 for filling one or more water balloons 31 with water 35, according to an example embodiment. Apparatus 30 generally includes at least one water balloon 31 coupled to a tube 32 using a valve 33. For explanatory purposes, water balloon 31 is shown in a filled state, with colloid particles 40 suspended within the water 35 filling water balloon 31. The size and shape of the colloid particles 40 is symbolic in this illustration and exaggerated for purposes of explanation. As explained further below, the colloid particles 40 may mitigate undesired leakage of water 35 from water balloon 31. In a particular embodiment, water balloon 31, tube 32, and valve 33 may be substantially similar in structure and function to certain embodiments of container 18A, tube 16A, and valve 20A, respectively, of the system 10 of FIG. 1.

In operation, tube 32 may provide a conduit for filling the water balloon 31 with water 35. Upon detachment of the water balloon 31 from the tube 32, valve 33 may be configured to sufficiently constrict the neck 34 of water balloon 31 to restrict any liquid 35 contained therein from escaping through the constricted opening, as explained previously with reference to FIG. 1. In certain embodiments, valve 33 has the capability to stretch from its natural state and to maintain a clamping force sufficiently strong to hold water balloon 31 to tube 32, prior to and during filling water balloon 31 with pressurized water 35, such as water from a garden hose. Valve 33 may be sized with an inner diameter sufficient to constrict the flexible neck 34 of water balloon 31 upon detachment from filling tube 32, thereby sealing the water balloon 31.

Figure 4:
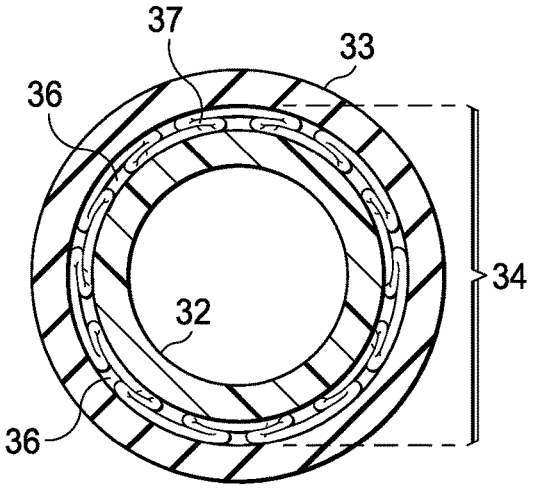
FIG. 4 illustrates a cross-sectional view of the apparatus illustrated in FIG. 3, from a perspective that bisects the elastic ring clamping a container to a tube.

FIG. 4 illustrates a cross-sectional view of the apparatus 30 illustrated in FIG. 1, from a perspective that bisects the valve 33 clamping water balloon 31 to tube 32 (i.e., along axis 4 shown in FIG. 3). As shown in FIG. 4, in certain instances there may exist undesirable gaps that may be at least partially caused, for example, by folds (e.g., fold 37) of the neck 34 portion of water balloon 31. As explained further with reference to FIG. 8, those folds may result in a leak path that risks allowing liquid to escape from the water balloon 31. Also shown is a potential point of adhesion (e.g., adhesion point 37) between valve 33 and the neck 34 of the water balloon 31, as well as points of adhesion between adjacent folds 37 of the neck of the water balloon 31. The adhesion points may contribute to formation of the gaps and accompanying leak paths.

Figure 5:
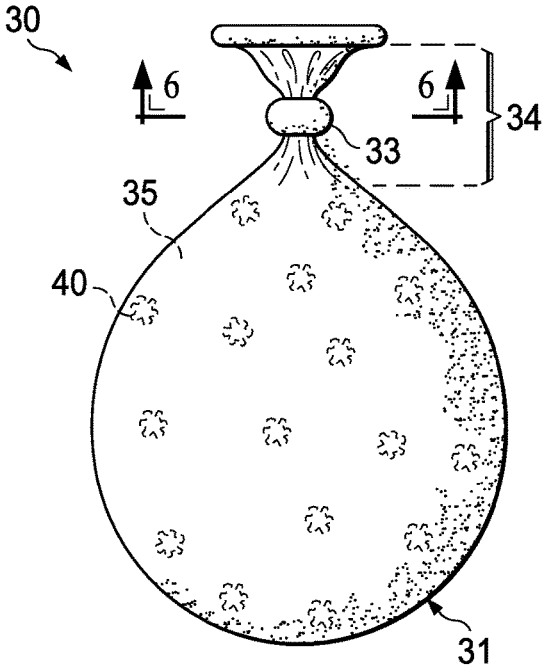
FIG. 5 illustrates the apparatus of FIG. 3, with the tube removed and the elastic ring further constricting the neck of the container to form a seal.

FIG. 5 illustrates the apparatus 30 of FIG. 3, with the tube 32 removed and the valve 33 constricting the neck 34 of the water balloon 31, thereby sealing the water 35 contained therein. The illustrated example represents the condition of the apparatus 30 immediately upon detachment from tube 32, which detachment has caused the valve 33 to constrict and seal the neck 34 of the water balloon 31.

Figure 6:
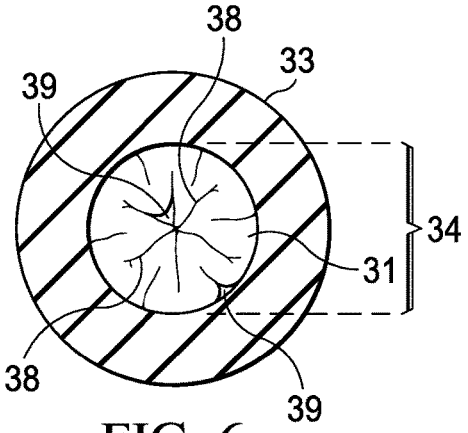
FIG. 6 illustrates a cross-sectional view of the sealed container of FIG. 5, from a perspective that bisects the constricted elastic ring.

FIG. 6 illustrates a cross-sectional view of the sealed water balloon 31 of FIG. 3, from a perspective that bisects the constricted valve 32 (i.e., along axis 6 shown in FIG. 5). At this state, immediately after detachment of water balloon 31 from its tube 32, there may be undesirable gaps (e.g., gaps 39) in the folds that may result in a leak path that can allow liquid to escape from the water balloon 31. Also shown are points potential adhesion (e.g., points 38) between the valve 33 and the neck 34 of the water balloon 31, as well as points of adhesion between adjacent folds of the neck of the container. The adhesion points may contribute to formation of the gaps and accompanying leak paths.

Figure 7:
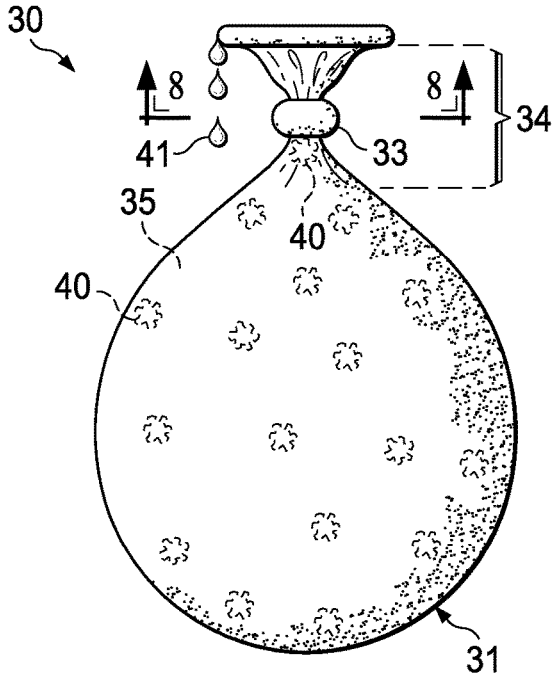
FIG. 7 illustrates the container of FIG. 5, after some amount of liquid has leaked through the gaps in the folds of the neck of the container.
Figure 8:
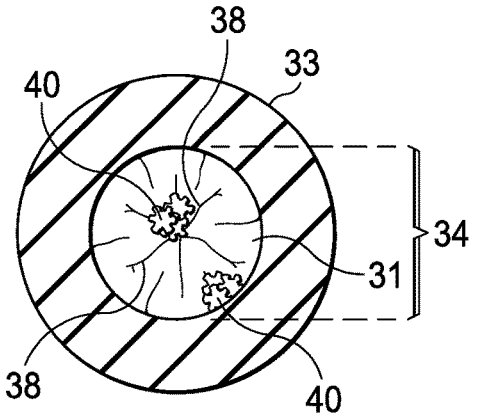
FIG. 8 illustrates a cross-sectional view of the sealed container of FIG. 7, after some amount of liquid has leaked through one or more gaps in the folds of the neck of the container and coagulant particulates have migrated to, and at least partially plugged, the gap(s)

FIG. 7 illustrates the water balloon 31 of FIG. 3, after some amount of water (symbolically represented as drops 41) has leaked through the gaps 39 in the folds of the neck 34 of the water balloon 31. Water pressure generated at least in part by the leak(s) at the neck 34 may cause certain colloid particles 40 to migrate toward the neck 34 and plug the gaps 39. The plugging of the gaps 39 by the colloid particles 40 is symbolically illustrated in the cross-sectional view of FIG. 8.

Figure 9:
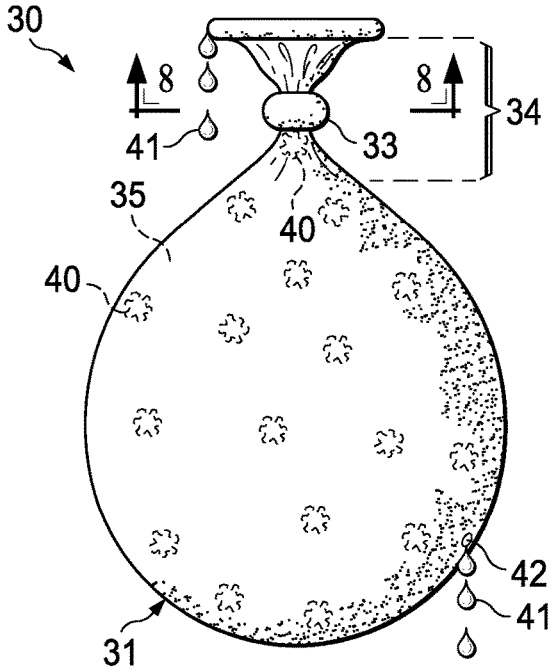
FIG. 9 illustrates a portion of the container of FIG. 5, after some amount of liquid has leaked through one or more pinhole defects in the container, according to an example embodiment.
Figure 10:
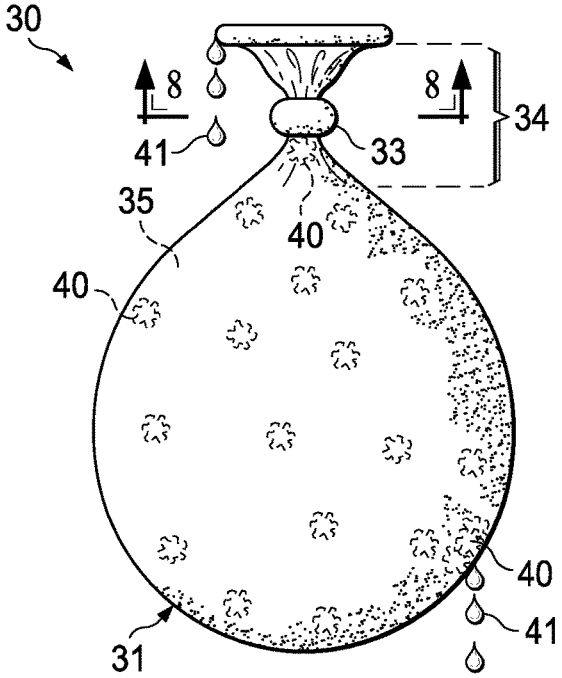
FIG. 10 illustrates the apparatus of FIG. 9, after some amount of liquid has leaked through the one or more pinhole defects and coagulant particulates have migrated to, and at least partially plugged, the pinhole defect(s).

FIG. 9 illustrates a portion of the apparatus 30 of FIG. 3 at a state where water balloon 31 is detached from tube 32 and has formed one or more pinhole defects 42, according to an example embodiment. As shown in FIG. 10, reference 41 symbolically indicates drops of water that had leaked through the pinhole defect 42. Water pressure generated at least in part by the pinhole defect 42 caused portions of the colloid particles 40 to migrate to and plug the pinhole, thereby stopping the water leak.

FIGS. 3 to 9 and the corresponding description have explained an example embodiment wherein the colloid acts to mitigate the leakage of water from a water balloon. A person skilled in the art will appreciate that where the container is instead filled with another type of fluid, certain colloid particles suspended in the fluid may be capable of mitigating leakage in much the same manner. For example, where the fluid filling the container is a gas, particular colloid particles may be suspended in the gas. Gas pressure generated at least in part by the leak may cause at least some of the suspended colloid particles to migrate toward the point(s) at which the leak is occurring and plug the corresponding hole(s).

Modifications, additions, or omissions may be made to balloon-filling apparatus without departing from the scope of the disclosure. The components of balloon-filling apparatus may be integrated or separated. For example, elastic ring 3 may be integrally formed with container 1. As used in this document, "each" refers to each member of a set or each member of a subset of a set. Additionally, while the drawings are not necessarily drawn to scale, each drawing shows relative proportionalities and dimensions that may apply to certain example embodiments. The term "or" as used herein is to be interpreted as an inclusive or meaning any one or any combination. Therefore, "A, B or C" means any of the following: "A; B; C; A and B; A and C; B and C; A, B and C". An exception to this definition will occur only when a combination of elements, functions, steps or acts are in some way inherently mutually exclusive.

Although the present disclosure has been described with several embodiments, a myriad of changes, variations, alterations, transformations, and modifications may be suggested to one skilled in the art, and it is intended that the present disclosure encompass such changes, variations, alterations, transformation, and modifications as they fall within the scope of the appended claims.

What is claimed is:

1. An apparatus for simultaneously filling balloons with water, comprising:

a fitting comprising an inlet and at least three outlets; and at least three branch assemblies coupled to the fitting, each branch assembly comprising:

a tube extending from the fitting at a respective one of the at least three outlets;

a balloon with a neck defining an opening through which an end of the tube is inserted;

an elastic ring compressing the neck of the balloon around the end of the tube, the elastic ring configured to restrict detachment of the balloon from the tube and to automatically seal the opening of the balloon upon detachment of the balloon from the tube, the restriction of the elastic ring being limited such that the balloon, if filled with a sufficient amount of water, is detachable by gravity or by gravity combined with a manually applied acceleration of the tube; and a plurality of colloid particles disposed within the balloon and, if suspended within water, are capable of plugging a hole having a maximum width of 200 microns that would otherwise permit water to leak from the balloon; and wherein the colloid particles disposed within the balloon, if suspended in water, result in a colloidal solution having a dynamic viscosity of 33 or less at 27° C. in centipoise.

2. The apparatus of claim 1, wherein the hole comprises a pinhole defect in the sidewall of the balloon.

3. The apparatus of claim 1, wherein the hole comprises a gap formed by compressed folds in the neck of the balloon.

4. The apparatus of claim 1, wherein the cumulative mass of the colloid particles disposed within the balloon is within the range of 0.05 to 0.5 grams.

5. The apparatus of claim 1, wherein the cumulative mass of the colloid particles disposed within the balloon is within the range of 0.2 to 2 grams per liter of water, for a maximum number of liters of water that the balloon may contain without bursting.

6. The apparatus of claim 1, wherein the colloid particles have respective maximum dimensions within the range of 1 nanometer to 0.1 centimeters.

7. The apparatus of claim 1, wherein the colloid particles have respective maximum dimensions within the range of 200 to 500 microns.

8. The apparatus of claim 1, wherein the colloid particles are biodegradable.

9. The apparatus of claim 1, wherein the colloid particles comprise gelatin.

10. An apparatus for simultaneously filling balloons with water, comprising:

a fitting comprising an inlet and at least three outlets; and at least three branch assemblies coupled to the fitting, each branch assembly comprising:

a tube extending from the fitting at a respective one of the at least three outlets;

a balloon with a neck defining an opening through which an end of the tube is inserted;

an elastic ring compressing the neck of the balloon around the end of the tube, the elastic ring configured to restrict detachment of the balloon from the tube and to automatically seal the opening of the balloon upon detachment of the balloon from the tube, the restriction of the elastic ring being limited such that the balloon, if filled with a sufficient amount of water, is detachable by gravity or by gravity combined with a manually applied acceleration of the tube; and a colloid source disposed within the fitting and configured to respond to a stream of water by supplying suspended colloid particles into the stream of water, such that each balloon receives a respective allotment of suspended colloid particles;

wherein the colloid particles suspended within each of the plurality of balloons result in colloidal solution have a dynamic viscosity of 33 or less at 27° C. in centipoise; and wherein the colloid source is in a form selected from the group consisting of a pill, powder, and a concentrated liquid; and wherein, for each balloon, the respective allotment of suspended colloid particles are capable of plugging a pinhole defect in the balloon.

11. The apparatus of claim 10, wherein, for each balloon, the respective allotment of suspended colloid particles are capable of plugging a pinhole defect 200 microns wide in the sidewall of the balloon that would otherwise permit water to leak from the balloon.

12. The apparatus of claim 10, wherein, for each balloon, the respective allotment of suspended colloid particles are capable of plugging a gap formed by compressed folds in the neck of the balloon that would otherwise permit water to leak from the balloon.

13. The apparatus of claim 10, wherein the cumulative mass of the respective allotment of suspended colloid particles is within the range of 0.05 to 0.5 grams.

14. The apparatus of claim 10, wherein the cumulative mass of the respective allotment of suspended colloid particles is within the range of 0.2 to 2 grams per liter of water, for a maximum number of liters of water that the balloon may contain without bursting.

15. The apparatus of claim 10, wherein the suspended colloid particles have respective maximum dimensions within the range of 1 nanometer to 0.1 centimeters.

16. The apparatus of claim 10, wherein the suspended colloid particles have respective maximum dimensions within the range of 200 to 500 microns.

17. The apparatus of claim 10, wherein the suspended colloid particles are biodegradable.

18. The apparatus of claim 10, wherein the suspended colloid particles comprise gelatin.

19. A method for simultaneously filling balloons with a fluid, comprising:

receiving at a colloid source a fluid stream from a fluid source, the colloid source disposed within a fitting comprising an inlet and at least three outlets, the fitting having at least three branch assemblies coupled to thereto, each branch assembly comprising:

a tube extending from the fitting at a respective one of the at least three outlets;

a balloon with a neck defining an opening through which an end of the tube is inserted;

an elastic ring compressing the neck of the balloon around the end of the tube, the elastic ring configured to restrict detachment of the balloon from the tube and to automatically seal the opening of the balloon upon detachment of the balloon from the tube, the restriction of the elastic ring being limited such that the balloon, if filled with a sufficient amount of water, is detachable by gravity or by gravity combined with a manually applied acceleration of the tube;

in automatic response to receiving the fluid stream at the colloid source, creating a colloid solution by passing colloid particles from the colloid source into the fluid stream; and providing a respective portion of the colloid solution to each of the balloons; and automatically plugging a pinhole defect in one of the balloons in response to internal pressure forcing some of the colloid particles of the colloid solution toward the pinhole defect.

* * * * *